US006080944A

United States Patent [19]

Itoigawa et al.

[11] Patent Number: 6,080,944

[45] Date of Patent: Jun. 27, 2000

[54] ACCELERATION ACTUATED MICROSWITCH

[75] Inventors: Koichi Itoigawa; Yutaka Yoshida, both of Aichi, Japan

[73] Assignee: Kabushiki Kaisha Tokai Rika Denki Seisakusho, Japan

[21] Appl. No.: 09/406,208

[22] Filed: Sep. 24, 1999

[30] Foreign Application Priority Data

Sep. 28, 1998 [JP] Japan ..... 10-273759

[51] Int. Cl.[7] ..... H01H 35/14

[52] U.S. Cl. ..... 200/61.45 R

[58] Field of Search ..... 73/488, 514.01–514.16, 73/514.21–514.24, 514.29, 514.35–514.38; 200/61.45 R–61.45 M

[56] References Cited

U.S. PATENT DOCUMENTS

| | | | |
|---|---|---|---|
| 5,060,504 | 10/1991 | White et al. | 73/1 D |
| 5,111,693 | 5/1992 | Greiff | 73/514 |
| 5,177,331 | 1/1993 | Rich et al. | 200/61.45 R |
| 5,383,364 | 1/1995 | Takahashi et al. | 73/517 R |
| 5,656,846 | 8/1997 | Yamada | 257/420 |
| 5,777,227 | 7/1998 | Cho et al. | 73/514.38 |
| 5,905,203 | 5/1999 | Flach et al. | 73/514.32 |

*Primary Examiner*—Michael Friedhofer
*Attorney, Agent, or Firm*—Fulbright & Jaworksi LLP

[57] ABSTRACT

A acceleration actuated microswitch that accurately detects accelerations in various directions is provided. A mass is supported by first beams in a space defined in a silicon substrate. The mass can be reciprocated in a direction perpendicular to the silicon substrate. A pair of second beams extend from the mass. Each second beam includes an electrode layer. A cover is secured to the silicon substrate. A pair of steps are formed in the inner surface of the cover. A pair of fixed contacts is located on each step. Each pair of contacts faces a corresponding electrode layer. When an acceleration having a certain magnitude is applied to the switch, the first beams are vibrated and the electrode layers contact the steps, which closes the switch.

29 Claims, 7 Drawing Sheets

ACCELERATION ACTUATED MICROSWITCH

BACKGROUND OF THE INVENTION

The present invention relates to a microswitch that is actuated by acceleration.

FIG. 14 illustrates the structure of a prior art acceleration actuated microswitch 10. The switch 10 includes a casing 11, a reed switch 12, a magnetic mass 13 and spring 14.

The mass 13 is fitted about and reciprocates relative to the casing 11 between a position away from the reed switch 12 and a position close to the reed switch 12. The spring 14 retains the mass 13 at the position away from the reed switch 12.

When acceleration G, along the longitudinal axis of the casing 11, is applied to the microswitch 10, the acceleration G causes the mass 13 to slide on the casing 11 toward the reed switch 12. At this time, the magnetic force of the mass 13 closes the reed switch. The time required for the mass 13 to move to the position to turn the reed switch 12 on and the length of the period during which the reed switch 12 is on depend on the dimensional accuracy of the mass 13 and the casing 11.

However, due to limitations of the dimensional accuracy of parts, the length of the on period cannot be extended beyond a certain value, and the size of the prior art microswitch cannot be further reduced. The on time of the reed switch 12 cannot be extended by a simple modification to the construction of the microswitch 10.

Since the mass 13 slides on the case 11, an acceleration in a direction other than the longitudinal direction of the case 11 is not accurately detected. That is, if an acceleration that is inclined relative to the longitudinal direction of the case 11 is applied to the switch 10, the acceleration generates frictional force between the mass 13 and the casing 11, which prevents the mass 13 from moving smoothly. In this case, the reed switch 12 may not be closed.

In some cases, it is preferable that the sensitivity of acceleration microswitches vary in accordance with the frequency of the applied acceleration. However, the sensitivity of the prior art acceleration microswitch 10 does not vary in accordance with the frequency of applied accelerations.

SUMMARY OF THE INVENTION

Accordingly, it is an objective of the present invention to provide a acceleration actuated microswitch that accurately detects applied accelerations and has a desired sensitivity for accelerations in various directions within a certain range.

To achieve the foregoing and other objectives and in accordance with the purpose of the present invention, an acceleration-actuated switch is provided. The switch includes a silicon substrate, a cover joined to the silicon substrate, a space defined by the silicon substrate and the cover, a fixed contact located on the cover facing the space, a mass located within the space, a first beam for connecting the mass to the silicon substrate so that the mass can move toward and away from the cover, and an electrode layer joined to the mass in opposition to the fixed contact. The electrode layer is positioned to contact the fixed contact when the mass moves toward the cover.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
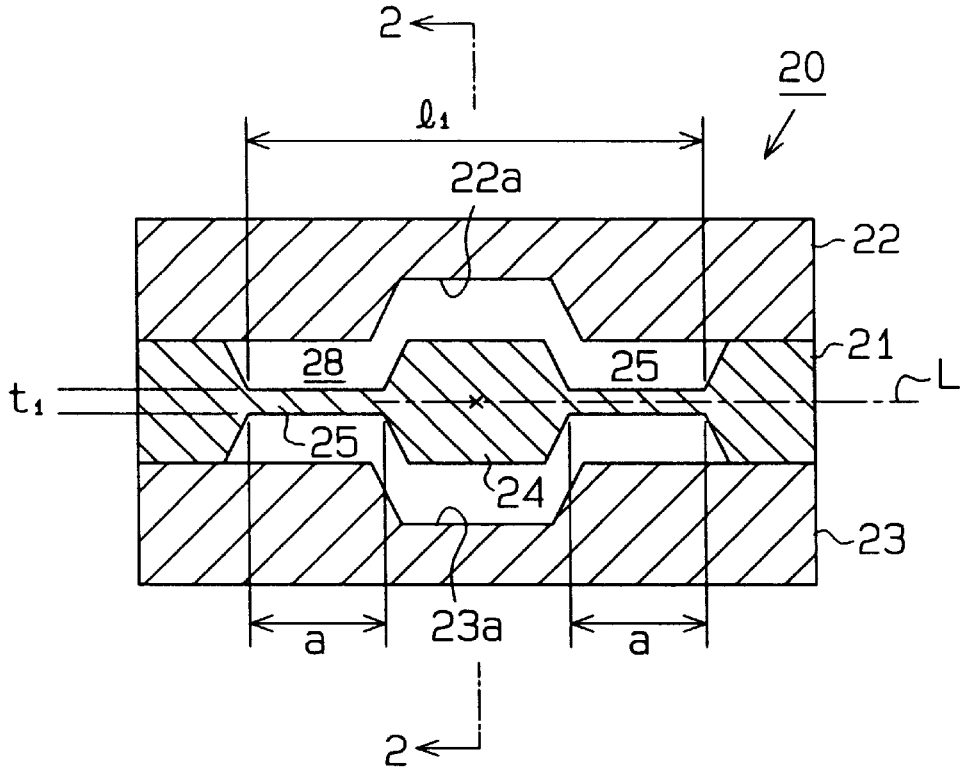
FIG. 1 is a cross-sectional view illustrating an acceleration actuated microswitch according to a first embodiment of the present invention.

A acceleration actuated microswitch 20 according to a first embodiment of the present invention will now be described with reference to FIGS. 1 to 8.

As shown in FIGS. 1 to 4, the acceleration actuated microswitch 20 includes a single-crystal silicon substrate 21 and first and second covers 22, 23. The covers 22, 23 are made of Pyrex (registered trademark) glass and are attached to the upper and lower sides of the substrate 21, respectively. Specifically, the first and second covers 22, 23 are adhered to and tightly contact the substrate 21 by anode bonding. In this embodiment, the thicknesses of the substrate 21, the first cover 22 and the second cover 23 are all 500 $\mu$m.

A hole is formed in the substrate 21. The inner wall of the hole, the lower surface of the first cover 22 and the upper surface of the second cover 23 define a closed space 28. A mass 24 is accommodated in the space 28 and supported by a pair of first beams 25. The thickness $t_1$ of the first beams 25 is less than that of the mass 24. The first beams 25 have the same length a. Therefore, the mass 24 is located in the center of the beams 25. The mass 24 and the first beams 25 are arranged such that the center of gravity of the mass 24 is on the axis L of the substrate 21 (see FIG. 1). As illustrated in FIG. 1, the mass 24 projects above and below the first beams 25.

Figure 4:
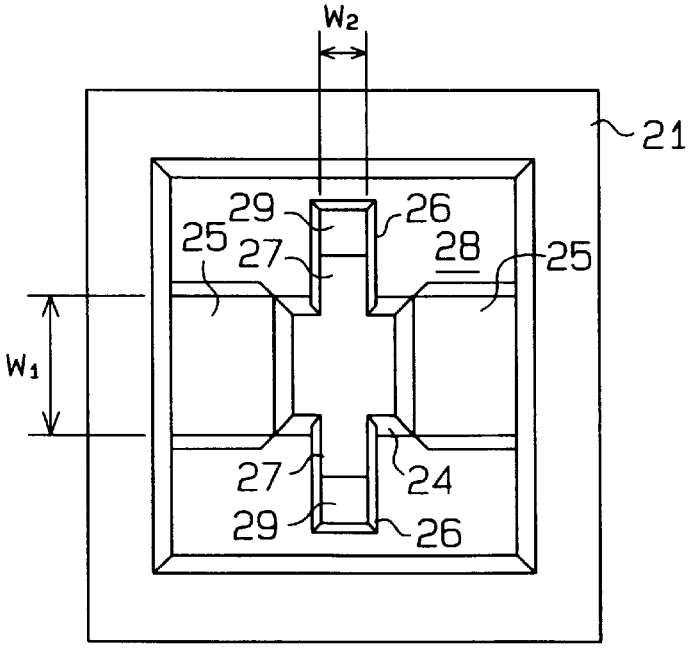
FIG. 4 is a plan view showing a silicon substrate of FIG. 1.

A pair of second beams 27 extend laterally from the upper side of the mass 24. Each second beam 27 supports an electrode base 26. A movable contact, or electrode layer 29, is formed on each electrode base 26. Each layer 29 is square shaped. As shown in FIG. 4, the axis of the second beams 27 is perpendicular to the axis of the first beams 25. The upper surface of the mass 24 is flush with the upper surface of each second beam 27. The thickness $t_2$ of each second beam 27 is less than the thickness $t_1$ of each first beam 25.

The natural frequencies of the first beams 25 and the second beams 27 will now be described.

Since the first beams 25 support the mass 24 from both sides, the first beams 25 and the mass 24 form a vibrating system. The natural frequency $\omega_1$ of the vibrating system is represented by the following equation (1)

$$\omega_1 = \frac{1_1}{a^2}\sqrt{\frac{El_1^3 w_1 t_1^3}{4m_1 a^2}} \tag{1}$$

On the other hand, each second beam 27 supports the corresponding electrode base 26 at one side. Thus, the natural frequency $\omega_2$ of each second beam 27, which includes the electrode base 26 and the electrode layer 29, is expressed by the following equation (2)

$$\omega_2 = \sqrt{\frac{Ew_2 t_2^3}{4m_2 l_2^3}} \tag{2}$$

Figure 2:
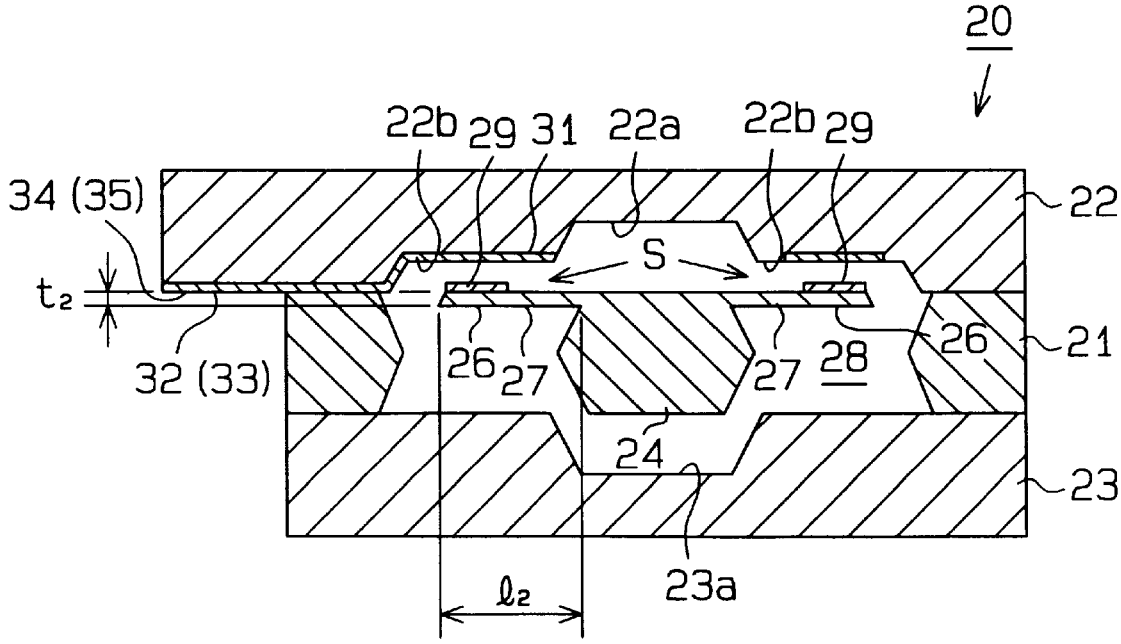
FIG. 2 is cross-sectional view taken along line 2—2 of FIG. 1.

Referring to FIGS. 1, 2 and 4

$m_1$: the sum of the weight of the first beams 25 and the mass 24

$m_2$: the sum of the weight of each second beam 27 and the corresponding electrode base 26 and the electrode layer 29 a: the length of each first beam 25

$l_1$: the sum of the lengths of the first beam 25 and the mass 24

E: the modulus of elasticity, in a vertical direction in FIG. 1, of the material forming the beams 25, 26 and the mass 24

$w_1$, $w_2$ are the widths of the first and second beams 25, 26

$t_1$, $t_2$ are the thicknesses of the first and second beams 25, 26

$l_2$ is the length of each second beam 27.

According to the equation (1), a greater thickness $t_1$ and a greater width $w_1$ of each first beam 25 lowers the natural frequency $\omega_1$ of the vibrating system.

According to the equation (2), a lesser thickness $t_2$ and a lesser length 12 of each second beam 27 raises the natural frequency $\omega_2$ of each second beam 27.

The space 28 defined by the mass 24, the first beams 25, the electrode base 26 and the second beams 27 is formed by performing anisotropic etching on the silicon substrate 21 with an etchant such as KOH. The substrate 21, the mass 24, the first beams 25, the electrode bases 26, the second beams 27 are made of a single crystal silicon having a crystal orientation of one hundred.

The mass 24, the first beams 25, the electrode bases 26 and the second beams 27 are formed by micro-machining before the covers 22, 23 are attached to the substrate 21, which improves the dimensional accuracy.

As shown in FIG. 4, the electrode layers 29 are formed on the top side of the corresponding electrode base 26. The electrode layers 29 are formed by a physical film forming technique such as vapor deposition or sputtering using metal such as gold, silver or aluminum.

Recesses 22*a*, 23*a* are formed in the first cover 22 and the second cover 23, respectively, at locations corresponding to the mass 24. The recesses 22*a*, 23*a* are large enough to receive the mass 24. The ceiling of the recess 22*a* functions as a second stopper. Also, the bottom of the recess 23*a* functions as a stopper when the mass 24 moves downward.

Figure 3:
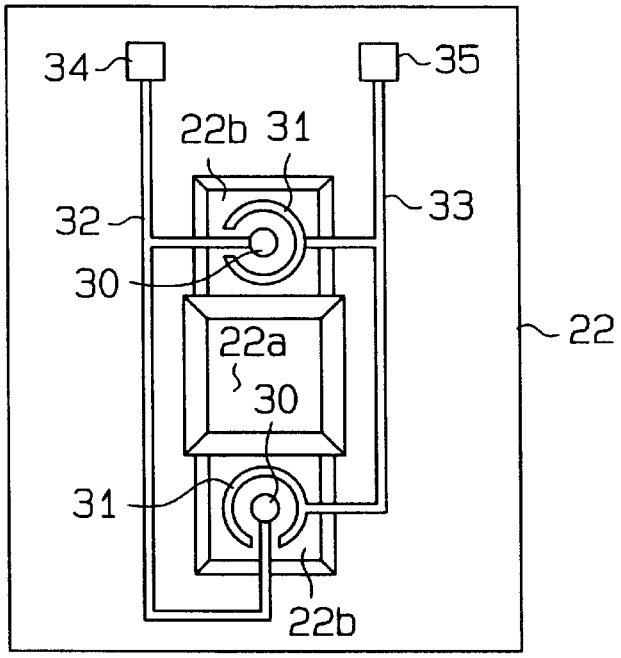
FIG. 3 is a bottom view showing a first cover of FIG. 1.

As shown in FIGS. 2 and 3, steps 22*b* are formed in the first cover 22 at locations corresponding to the second beams 27 and the electrode bases 26. The steps 22*b* are adjacent to and shallower than the recess 22*a*. Each step 22*b* is large enough to receive the corresponding second beam 27. The steps 22*b* form first stoppers. The first stopper, or the steps 22*b*, and the second stepper, or the recess 22*a*, are on different planes as shown in FIG. 2. When the mass 24 is moved upward, the electrode bases 26 first contact the steps 22*b*. Thereafter, the mass 24 contacts the ceiling of the recess 22*a*.

A disk-shaped first fixed contact 30 and a C-shaped second fixed contact 31 are formed on each step 22*b*. The second fixed contact 31 surrounds and is concentric with the first fixed contact 30. The fixed contacts 30, 31 are formed with gold by a physical film forming technique such as vapor deposition or sputtering. Each first fixed contact 30 and the associated second fixed contact 31 are located above a movable contact, which is the corresponding electrode layer 29. When the electrode layer 29 makes an electrical connection between the step 22*b*, the layer 29 connects the contacts 30 and 31. The layer 29, the first fixed contact 30 and the second contact 31 form a switch S.

As shown in FIG. 3, aluminum lines 32, 33 are located on the inner surface of the first cover 22. The lines 32, 33 are formed by a physical film forming technique such as vapor deposition or sputtering. The lines 32, 33 are connected to the first fixed contacts 30 and the second fixed contacts 31, respectively. The outer ends of the lines 32, 33 are located outside the substrate 21 and are connected to pads 34, 35, respectively.

Operation of the acceleration actuated microswitch 20 will now be described.

The frequency sensitivity of the first beams 25 is different from that of the second beams 27, and the natural frequency of each first beam 25 is lower than that of each second beam 27. Thus, when a downward acceleration having a high frequency is applied to the switch 20, the first beams 25 are not vibrated. Therefore, each movable contact does not contact the corresponding fixed contacts 30, 31 and the switch S is not turned on.

Figure 6:
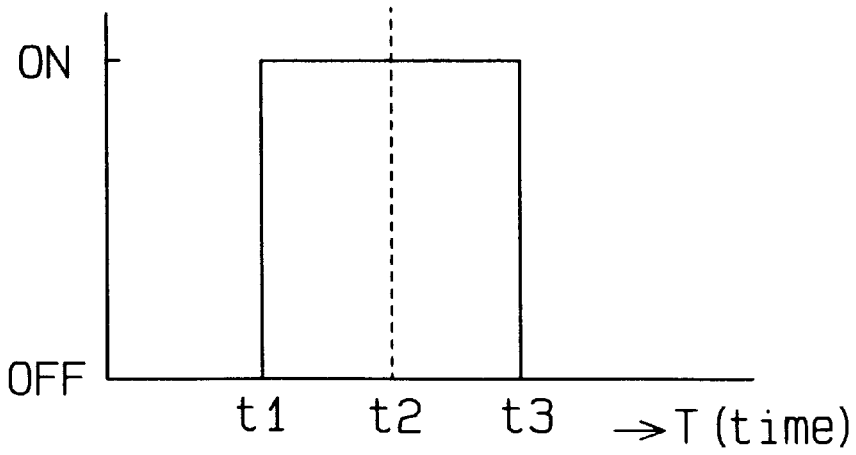
FIG. 6 is a timing chart showing the on state of the acceleration actuated microswitch of FIG. 1.
Figure 7:
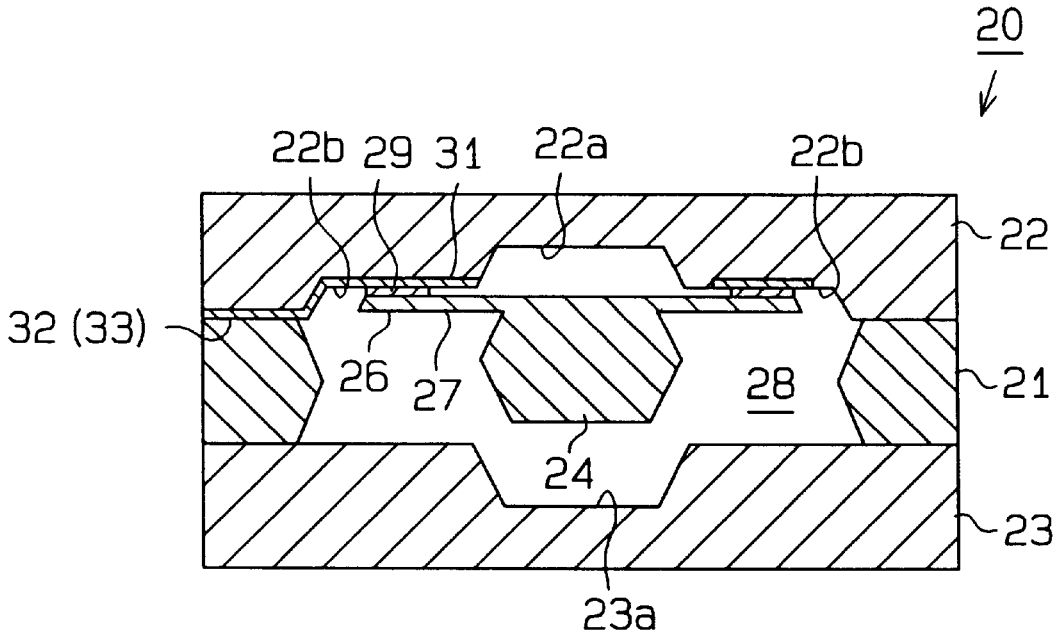
FIG. 7 is a cross-sectional view like FIG. 2, illustrating operation of the microswitch.

When a downward acceleration having a low frequency is applied to the switch 20, the first beams 25 is vibrated. Then, when the mass 24 is moved upward as illustrated in FIG. 7, the second beams 27 contact the steps 22*b*, which permits the electrode layers 29 to touch the first and second fixed contacts 30 and 31 thereby closing the switch S. FIG. 6 shows the times at which the switch S is turned on and off. Specifically, the switch S is turned on at time t1.

Figure 8:
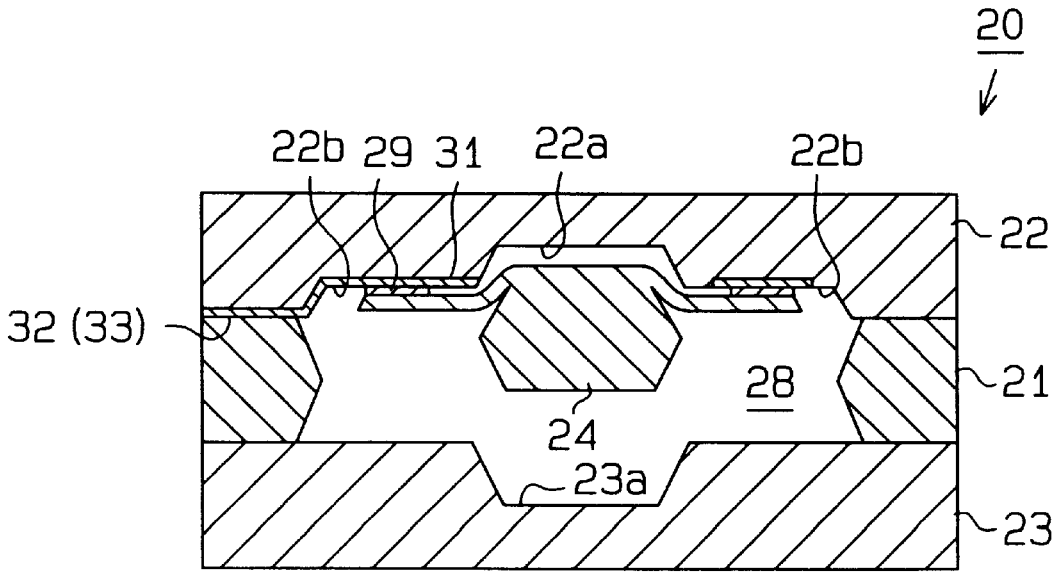
FIG. 8 is a cross-sectional view like FIG. 2, illustrating operation of the microswitch.

After the second beams 27 contact the steps 22*b*, the acceleration further moves the mass 24 into the recess 22*a* as illustrated in FIG. 8. As a result, the first fixed contacts 30 and the second fixed contacts 31 are electrically connected by the electrode layer 29 for awhile. In FIG. 8, the displacement of the mass 24 is illustrated in an exaggerated manner.

In the timing chart of FIG. 6, the acceleration disappears at a time t2. Then, the mass 24 is moved downward by the elasticity of the first beams 25. At a time t3, the mass 24 is separated from the recess 22*a* and the second beams 27 are separated from the steps 22*b*. The switch S is therefore on, or closed, during the period between the time t1 and the time t3.

If an applied acceleration is relatively great, the mass 24 is moved until it contacts the ceiling of the recess 22*a*. Thereafter, when the acceleration disappears, the mass 24 is moved in the opposite direction by the elasticity of the first beams 25.

The embodiment of FIGS. 1 to 8 has the following advantages.

(1) The first beams 25 are thinner than the mass 24 and have equal lengths. The center of gravity of the mass 24 is located on the axis L (see FIG. 1), which prevents the mass 24 from being twisted. Thus, the electrode layers 29 are prevented from contacting the fixed contacts 30, 31 due to twisting of the mass 24. Also, unlike the prior art mass 13, which slides along the casing 11, the mass 24 is supported by the first beams 25. Therefore, the movement of the mass 24 is not affected by friction. When an acceleration is applied in a direction that is inclined relative to the vertical direction of the microswitch 20, the microswitch 20 is positively turned on.

Figure 5:
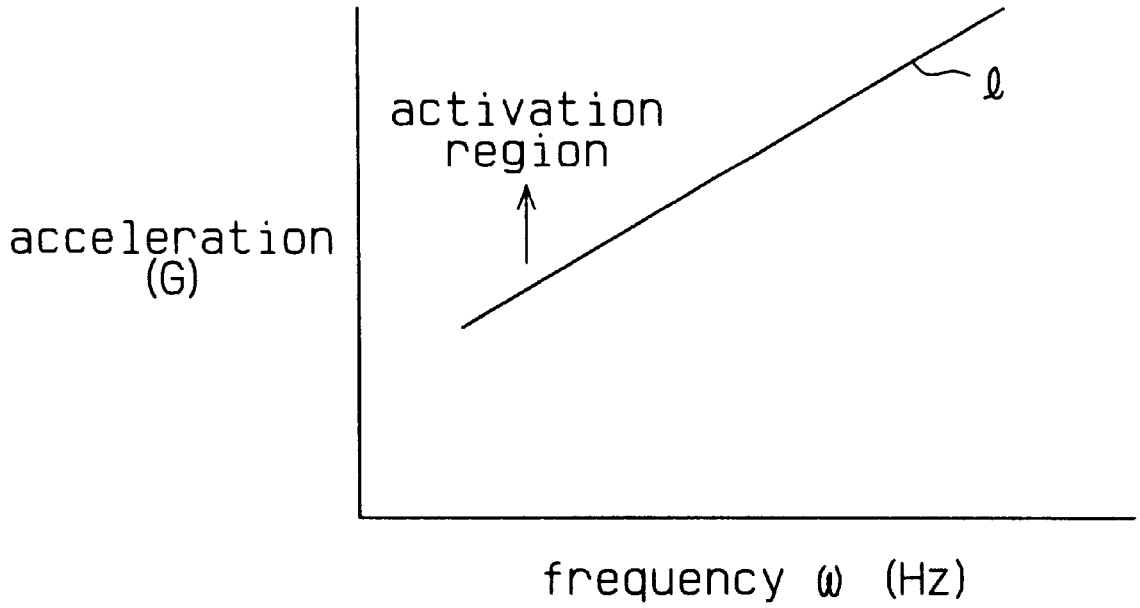
FIG. 5 is a graph showing sensitivity of the microswitch of FIG. 1 in relation to frequency and magnitude of applied accelerations.

(2) The thickness $t_1$ of each first beam 25 is relatively great and the width $w_1$ of each first beam 25 is relatively great, which lowers the natural frequency of each first beam 25. The thickness $t_2$ of each second beam 27 is relatively small and the length $l_2$ of each second beam 27 is relatively small, which raises the natural frequency of each second beam 27. As a result, when a high-frequency acceleration is applied to the switch 20, the mass 24 is not significantly vibrated. When a low-frequency acceleration is applied to the switch 20, the mass 24 is greatly vibrated. Accordingly, the acceleration sensitivity characteristics shown in FIG. 5 are obtained. Specifically, the characteristics are shown by line l, which represents the magnitude of an applied acceleration and its frequency ω. The area above line l is an activation area in which the switch 20 is turned on. For higher frequencies ω, the microswitch 20 is activated by greater accelerations G.

(3) The steps 22*b* and the recess 22*a* have planer surfaces that are parallel to the plane of the substrate 21. The steps 22*b* and the recess 22*a* are at different levels such that the electrode bases 26 first contact the steps 22*b* when the mass 24 moves upward. As a result, when an acceleration is applied to the switch 20, the electrode bases 26 first contact the steps 22*b* and then the mass 24 contacts the ceiling of the recess 22*a*. In this sate, the closure of switch 20 is maintained until the acceleration disappears and the mass 24 is returned to the level of the steps 22*b* by the resiliency of the first beams 25.

(4) Each first fixed contact 30 is disk-shaped and each second fixed contact 31 is C-shaped to surround the corresponding first contact 30. Further, each first contact 30 and the corresponding second contact 31 are concentric. When one of the electrode layers 29 contacts the step 22*b*, it electrically connects the corresponding first contact 30 with the corresponding second contact 31. Therefore, even if one of the layers 29 contacts the corresponding step 22*b* when the second beams 27 and the base 26 are inclined, the one layer 29 connects the corresponding second contact 31 with corresponding the first contact 30.

(5) The microswitch 20 has two sets of the first and second fixed contacts 30 and 31 and one of the electrode layers 29 corresponds to each one of the sets of the contacts 30 and 31. Thus, when an acceleration is applied to the switch 20, only one of the layers 29 needs to contact the corresponding contacts 30, 31. Accordingly, the detection accuracy of the switch 20 is improved.

A second embodiment will now be described with reference to FIGS. 9 and 10.

The differences from the embodiment of FIGS. 1 to 8 will mainly be discussed below, and like or the same reference numerals are given to those components that are like or the same as the corresponding components of the embodiment of FIGS. 1 to 8.

In this embodiment, a thin-film resistor R2 is located between the lines 32 and 33. The resistor R2 and the fixed contacts 30, 31 are connected in parallel. The resistor R2 is formed with Cr—Si or Cr—Si—Ti by a physical film forming technique such as vapor deposition or sputtering.

The resistor R2 in the switch 20 eliminates the need for a discrete resistor in the circuit including the microswitch 20.

Figure 10:
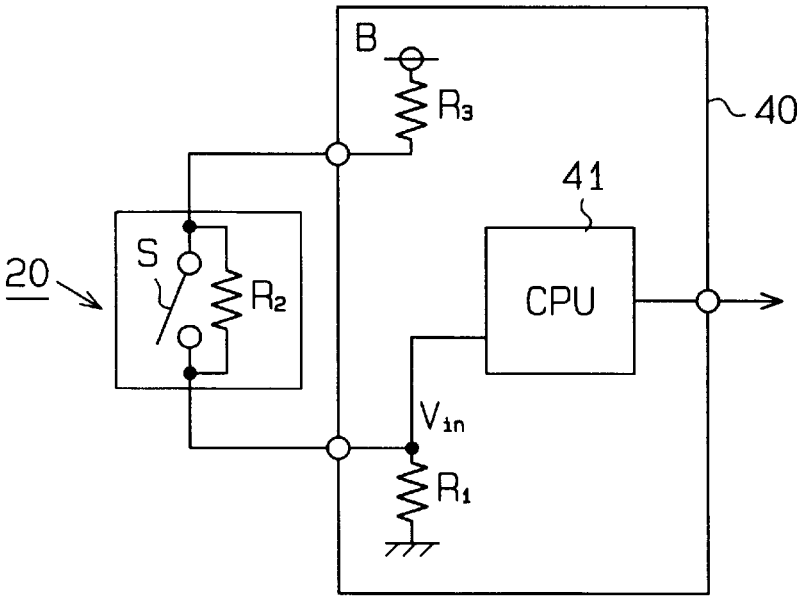
FIG. 10 is an electrical block diagram illustrating an air bag system using the acceleration actuated microswitch of FIG. 9.

FIG. 10 is a block diagram illustrating a circuit of an air bag system having the acceleration actuated microswitch 20.

An electronic control unit, or air bag ECU 40, includes a resistor R3 connected to a battery B, a central processing unit (CPU) 41 and a resistor R1. A minus terminal of the resistor R3 is connected to the switch S and the resistor R1 in series. A plus terminal of the resistor R1 is connected to a signal input terminal of the CPU 41 and a minus terminal is grounded.

When there is no acceleration acting on the air bag system, the switch S of the microswitch 20 is turned off, or open. In this state, the voltage of the battery B is divided by the resistors R1, R2 and R3. The relatively low voltage at the resistor R1 is inputted to the CPU 41. When receiving the low voltage, the CPU 41 judges that an acceleration that is greater than a predetermined value is not acting and is thus in standby state.

When an acceleration that is greater than the predetermined value acts on the acceleration actuated microswitch 20 and closes the switch S, the voltage B is divided by the resistors R3 and R1 and raises the electric potential Vin at the resistor R1. The voltage of the resistor R1, which is relatively high, is inputted to the CPU 41. The CPU 41 judges that an acceleration greater than the predetermined level is acting on the acceleration actuated microswitch 20 and sends an inflation signal to an air bag inflating device (not shown).

Figure 9:
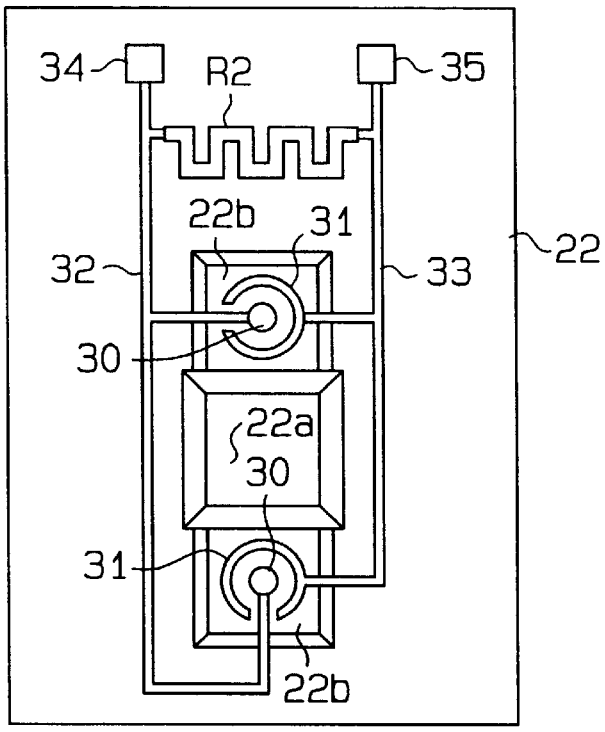
FIG. 9 is a bottom view of a cover of an acceleration actuated microswitch according to a second embodiment of the present invention.

The embodiment of FIGS. 9 and 10 has the following advantages.

(1) The acceleration actuated microswitch 20 of FIGS. 9 and 10 has the advantages (1) to (5) of the switch 20 of FIGS. 1 to 8.

(2) The thin film resistor R2 is formed on the first cover 22, which eliminates the need for a discrete resistor in the acceleration actuated microswitch 20 thereby reducing the size of the air bag system. If the air bag system includes a discrete resistor, the air bag system will be cumbersome despite the reduced size of the microswitch 20.

(3) The thin film resistor R2 is made of Cr—Si or Cr—Si—Ti, which improves the temperature-resistance characteristics of the acceleration actuated microswitch 20. That is, when the temperature of a resistor made of a carbon-film or a metal-film is changed, the resistance value of the resistor is changed by a few percent. When the temperature of a resistor R2 is changed, the resistance value of the resistor R2 is changed by only an insignificant amount.

A third embodiment will now be described with reference to FIGS. 11 to 13.

Figure 11:
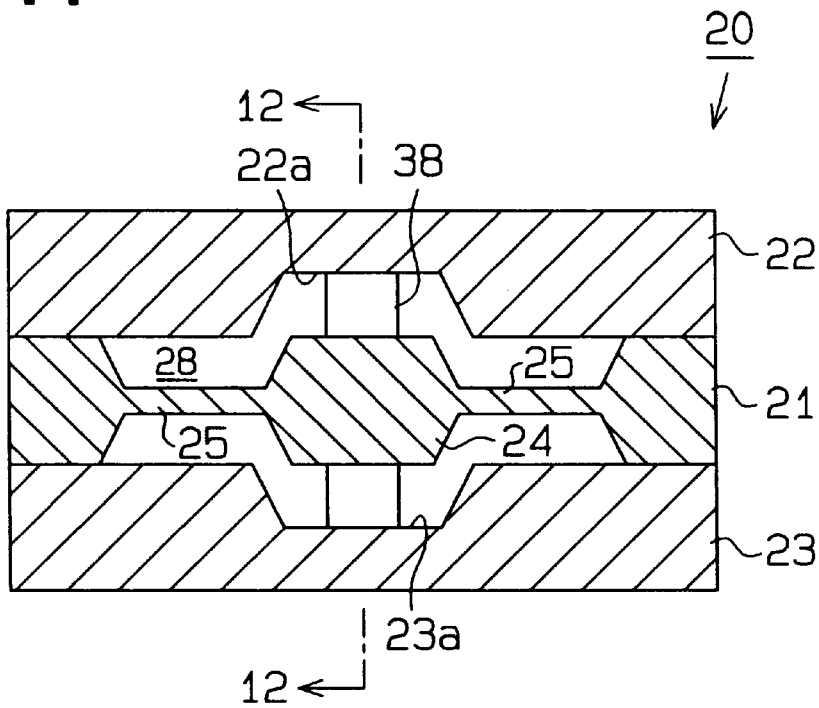
FIG. 11 is a cross-sectional view illustrating an acceleration actuated microswitch according to a third embodiment of the present invention.
Figure 12:
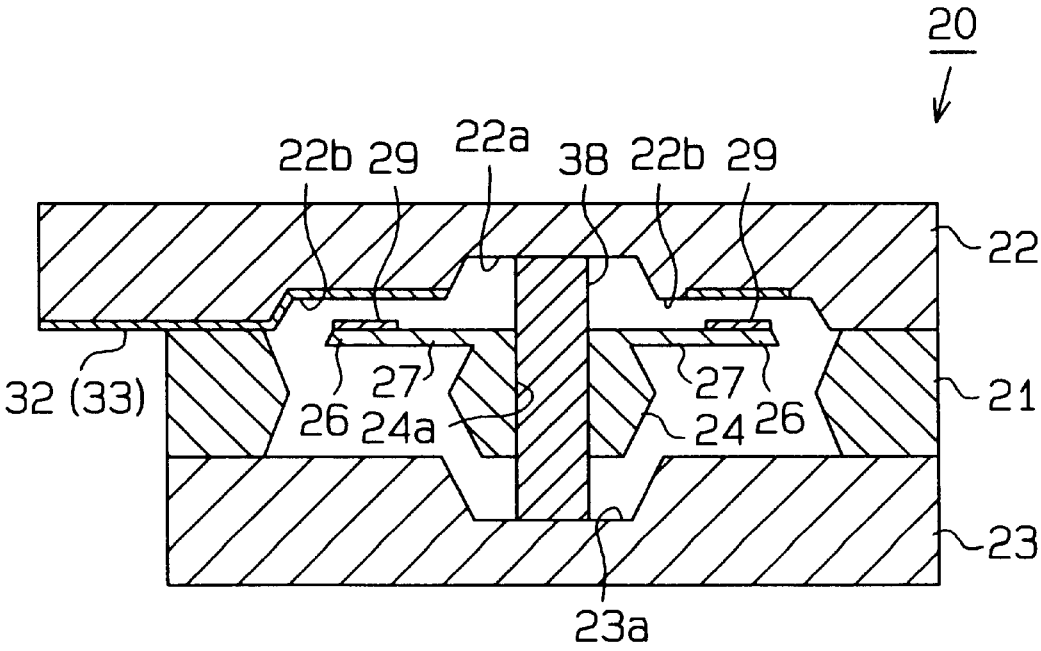
FIG. 12 is cross-sectional view taken along line 12—12 of FIG. 11.
Figure 13:
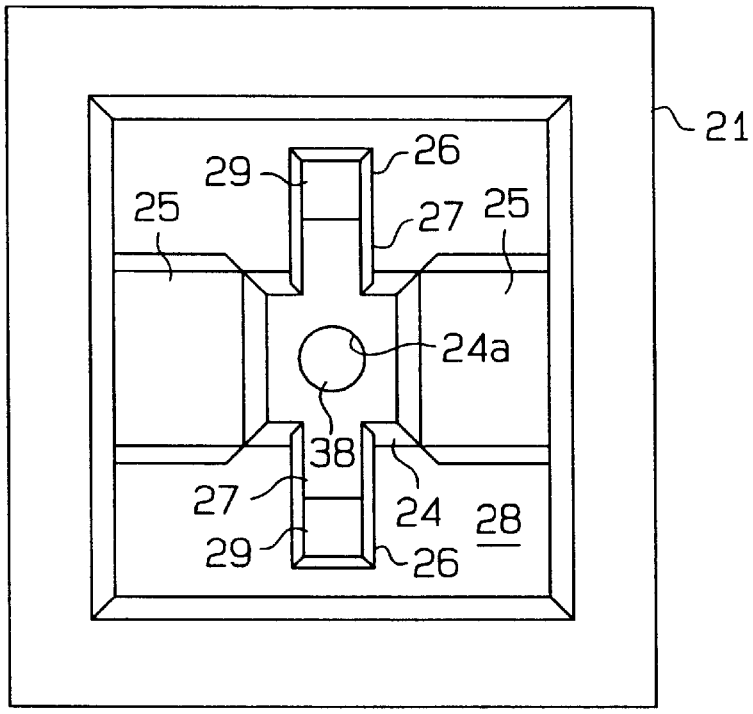
FIG. 13 is a plan view showing a silicon substrate of FIG. 11.
Figure 14:
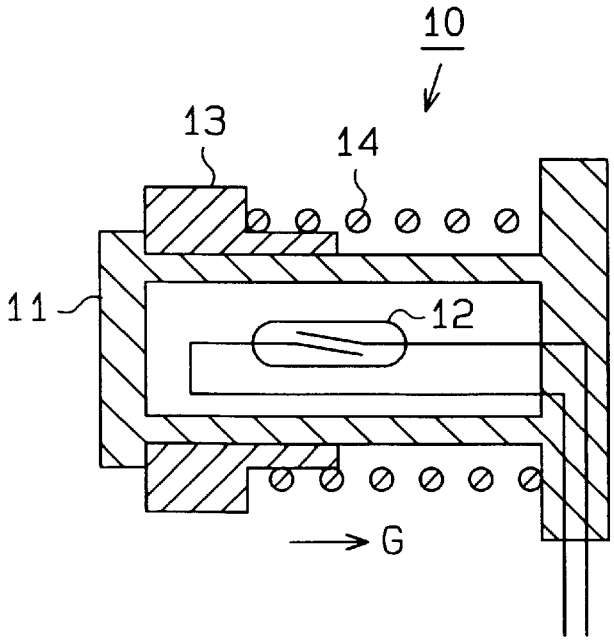
Fig.14 (PRIOR ART)
FIG. 14 is a cross-sectional view illustrating a prior art acceleration actuated microswitch.

As illustrated in FIGS. 11 to 13, a through hole 24*a* passes vertically through the mass 24. A silicon gel damper 38 extends through the through hole 24*a*. The damper 38 is loosely fitted in the hole 24*a* such that the mass 24 slides with respect to the damper 38. In other words, the mass 24 moves vertically relative to the damper 38. The upper and lower ends of the damper 38 contact the recesses 22*a*, 23*a*, respectively. The damper 38 and the hole 24*a* form a damping mechanism.

When a vertical acceleration that is greater than a predetermined value is applied to the microswitch 20, the mass 24 is moved relative to the damper 38. At this time, the wall of the hole 24*a* slides on the damper 38, which dampens the movement of the mass 24. That is, if a downward acceleration is applied to the switch 20 in FIGS. 11 and 12, the first beams 25 are moved upward relative to the damper 38 and the second beams 27 contact the steps 22*b*. Accordingly, each electrode layer 29 electrically connects the corresponding first fixed contact 30 with the associated contact 31, which turns the switch S on.

When the second beams 27 contact the steps 22*b*, the acceleration still acts on the mass 24 and further moves the mass 24 into the recess 22*a*. At this time, the movement of the mass 24 is slowed by the damping effect of the damper 38. As a result, the layers 29 are located at a position to connect the first contacts 30 with the second contacts 31. That is, the closure of the switch S is maintained.

When the acceleration disappears, the mass 24 is moved in the opposite direction by the resiliency of the first beams 25. At this time the returning movement of the mass 24 is slowed by the damper 38. When the mass 24 is separated from the steps 22*b*, the second beams 27 are also separated from the steps 22*b*. The on time is extended in comparison to that of the embodiment of FIGS. 1 to 8 due to the damping effect of the damper 38.

The embodiment of FIGS. 11 to 13 has the following advantages.

(1) The acceleration actuated microswitch 20 of FIGS. 11 to 13 has the advantages (2) to (5) of the switch 20 of FIGS. 1 to 8.

(2) The damper 38 extends through the mass 24, and the mass 24 moves relative to damper 38. When an acceleration acts on the switch 20, the damper 38 keeps the mass 24 at the on position of the switch S for a relatively long period.

It should be apparent to those skilled in the art that the present invention may be embodied in many other specific forms without departing from the spirit or scope of the invention. Particularly, it should be understood that the invention may be embodied in the following forms.

(1) In the illustrated embodiments, the covers 22 and 23 are made of Pyrex glass. However, the covers 22, 23 may be made of silicon substrate. Alternatively, only one of the first cover 22 or the second cover 23 may be made of silicon substrate.

(2) In the illustrated embodiments, the mass 24, the first beams 25, the electrode bases 26 and the second beams 27 are formed by micro-machining a single crystal silicon having a crystal orientation of one hundred. However, a single crystal silicon having a crystal orientation of one hundred and ten may be used. If a single crystal silicon having a crystal orientation of one hundred is used, the etched surfaces, or the side wall of the space 28 and the side wall of the mass 24, are not vertical relative to the surfaces of the covers 22 and 23 as shown in the drawings. If a single crystal silicon having a crystal orientation of one hundred and ten is used, etched surfaces will be vertical relative to the surfaces of the covers 22 and 23.

(3) In the illustrated embodiments, the second cover 23, which is separate from the substrate 21, is used. Instead of using the second cover 23, the silicon substrate 21 may be twice as thick as that in the illustrated embodiment, and the space 28 may be formed below the mass 24 through anode forming.

(4) In the illustrated embodiments, the first and second fixed contacts 30, 31, which form the switch S, are formed in the first cover 22. Likewise the first and second contacts 30, 31 and aluminum lines may be formed in the second cover 23.

(5) The aluminum lines 32, 33 in the illustrated embodiments may be replaced with chromium lines.

The present examples and embodiments are to be considered as illustrative and not restrictive and the invention is not to be limited to the details given herein, but may be modified within the scope and equivalence of the appended claims.

What is claimed is:

1. An acceleration-actuated switch, comprising:

a silicon substrate;

a cover joined to the silicon substrate;

a space defined by the silicon substrate and the cover;

a fixed contact located on the cover facing the space;

a mass located within the space;

a first beam for connecting the mass to the silicon substrate so that the mass can move toward and away from the cover;

a second beam provided at the mass; and an electrode layer joined through the second beam to the mass in opposition to the fixed contact, the electrode layer being positioned to contact the fixed contact when the mass moves toward the cover, wherein the second beam has a surface opposing the cover, the mass has a surface opposing the cover, and the surface of the beam and the surface of the mass are coplanar.

2. An acceleration-actuated switch as recited in claim 1, wherein the first beam is one of a pair of first beams for connecting the mass to the silicon substrate and opposite sides of the mass are connected to the silicon substrate by the first beams, respectively, and wherein one side of the electrode layer is attached to the second beam.

3. An acceleration-actuated switch as recited in claim 1, wherein the electrode layer is one of a pair of electrode layers joined to the mass and the second beam is one of a pair of second beams to which the electrode layers are joined, respectively, and wherein the fixed contact is one of a pair of fixed contacts located on the cover corresponding respectively to the pair of electrode layers.

4. An acceleration-actuated switch as recited in claim 1, wherein the first beam has a relatively great thickness and a relatively great width so as to have a low natural frequency, and wherein the second beam has a relatively small thickness and a relatively small length so as to have a high natural frequency.

5. An acceleration-actuated switch as recited in claim 1, wherein the first beam has a first axis, the second beam has a second axis, and the first axis is perpendicular to the second axis.

6. A acceleration actuated microswitch as recited in claim 1, wherein the mass, the first beam and the second beam are formed by micro-machining to the silicon substrate before the cover is joined to the silicon substrate.

7. An acceleration-actuated switch as recited in claim 1, wherein the cover has a first stop surface, which the electrode layer contacts and which supports the fixed contact, and a second stop surface, which the mass contacts, wherein the first stop surface and the second stop surface are perpendicular to the direction in which the mass moves, the first stop surface being separated from the second stop surface so that the electrode layer contacts the first stop surface before the mass contacts the second stop surface when the mass moves toward the cover.

8. An acceleration-actuated switch as recited in claim 1, wherein the fixed contact is a first fixed contact, and a second fixed contact is also located on the cover facing the space, and the electrode layer is positioned to contact both the first and the second fixed contact when the mass moves toward the cover, the second fixed contact being generally annular in form and the first fixed contact being separated from the second fixed contact and formed inside the second fixed contact, wherein the electrode layer electrically connects the first fixed contact and the second fixed contact when the electrode layer contacts the first fixed contacts.

9. An acceleration-actuated switch as recited in claim 1, wherein the mass includes a damping mechanism, the damping mechanism serving to extend the time of contact between the electrode layer and the fixed contact.

10. An acceleration-actuated switch as recited in claim 9, wherein the damping mechanism comprises a through-hole formed through the mass and a damping member fitted loosely in the through-hole, the damping member being supported by the cover.

11. An acceleration-actuated switch as recited in claim 10, wherein the damping member is composed of silicon gel.

12. An acceleration-actuated switch as recited in claim 1, further comprising a thin film resistor formed on the cover and connected in parallel to the fixed contact.

13. An acceleration-actuated switch, comprising: a silicon substrate having two sides;

a first and a second covers joined respectively to the two sides of the silicon substrate;

a space defined by the silicon substrate and the first and the second covers;

a first fixed contact and a second fixed contact located on the first cover to face the space;

a mass located within the space;

a pair of first beams for connecting opposite sides of the mass to the silicon substrate so that the mass can move toward and away from the first cover;

a first electrode layer and a second electrode layer joined to the mass in opposition to the first and second fixed contacts, respectively, the electrode layers being positioned to contact the fixed contacts, respectively, when the mass moves toward the first cover; and a pair of second beams for connecting the first and second electrode layers to the mass, respectively, wherein the first beams have a common axis, the second beams have a common axis, and the axis of the second beams is perpendicular to the axis of the first beams, and wherein a surface common to the second beams is coplanar to a surface of the mass.

14. An acceleration-actuated switch as recited in claim 13, wherein the first beams have a relatively great thickness and a relatively great width so as to have a low natural frequency, and wherein the second beams have a relatively small thickness and a relatively small length so as to have a high natural frequency.

15. An acceleration-actuated switch as recited in claim 13, wherein the first cover has first stop surfaces which the first and second electrode layers contact, respectively, and which support the first and second fixed contacts, and second stop surfaces which the mass contacts after the first and second electrode layers contact the first stop surfaces.

16. An acceleration-actuated switch as recited in claim 13, wherein the mass, the first beams and the second beams are formed by micro-machining to the silicon substrate before the covers are joined to the silicon substrate.

17. An acceleration-actuated switch, comprising:

a silicon substrate having two sides;

first and second covers joined respectively to the two sides of the silicon substrate;

a space defined by the silicon substrate and the first and the second covers;

a first fixed contact and a second fixed contact located on the first cover to face the space;

a mass located within the space;

a pair of first beams for connecting opposite sides of the mass to the silicon substrate so that the mass can move toward and away from the first cover;

a first electrode layer and a second electrode layer joined to the mass in opposition to the first and second fixed contacts, respectively, the electrode layers being positioned to contact the fixed contacts, respectively, when the mass moves toward the first cover;

a pair of second beams for connecting the first and second electrode layers to the mass, respectively, wherein the axis of the second beams is perpendicular to the axis of the first beams, and wherein a surface common to the second beams is coplanar to a surface of the mass; and a damping mechanism for extending the time of contact between the electrode layers and the first and second fixed contacts, the damping mechanism comprising a through-hole formed through the mass and a damping member fitted loosely in the through-hold, the damping member being supported by the first and the second covers.

18. An acceleration-actuated switch as recited in claim 17, wherein the damping member is composed of silicon gel.

19. An acceleration-actuated switch, comprising: a silicon substrate;

a cover joined to the silicon substrate:

a space defined by the silicon substrate and the cover;

a fixed contact located on the cover facing the space;

a mass located within the space;

a first beam for connecting the mass to the silicon substrate so that the mass can move toward and away from the cover;

wherein the cover has a first stop surface, which the electrode layer contacts and which supports the fixed contact, and a second stop surface, which the mass contacts, wherein the first stop surface and the second stop surface are perpendicular to the direction in which the mass moves, the first stop surface being separated from the second stop surface so that the electrode layer contacts the first stop surface before the mass contacts the second stop surface when the mass moves toward the cover.

20. An acceleration-actuated switch as recited in claim 19, wherein the first beam is one of a pair of first beams for connecting the mass to the silicon substrate and opposite sides of the mass are connected to the silicon substrate by the first beams, respectively, and wherein one side of the electrode layer is attached to the second beam.

21. An acceleration-actuated switch as recited in claim 20, wherein the electrode layer is one of a pair of electrode layers joined to the mass and the second beam is one of a pair of second beams to which the electrode layers are joined, respectively, and wherein the fixed contact is one of a pair of fixed contacts located on the cover corresponding respectively to the pair of electrode layers.

22. An acceleration-actuated switch as recited in claim 19, wherein the first beam has a relatively great thickness and a relatively great width so as to have a low natural frequency, and wherein the second beam has a relatively small thickness and a relatively small length so as to have a high natural frequency.

23. An acceleration-actuated switch as recited in claim 19, wherein the first beam has a first axis, the second beam has a second axis, and the first axis is perpendicular to the second axis.

24. An acceleration-actuated microswitch as recited in claim 19, wherein the mass, the first beam and the second beam are formed by micro-machining to the silicon substrate before the cover is joined to the silicon substrate.

25. An acceleration-actuated switch as recited in claim 19, wherein the fixed contact is a first fixed contact, and a second fixed contact, is also located on the cover facing the space, and the electrode layer is positioned to contact both the first and the second fixed contact when the mass moves toward the cover, the second fixed contact being generally annular in form and the first fixed contact being separated from the second fixed contact and formed inside the second fixed contact, wherein the electrode layer electrically connects the first fixed contact and the second fixed contact when the electrode layer contacts the fixed contacts.

26. An acceleration-actuated switch as recited in claim 19, wherein the mass includes a damping mechanism, the damping mechanism serving to extend the time of contact between the electrode layer and the fixed contact.

27. An acceleration-actuated switch as recited in claim 26, wherein the damping mechanism comprises a through-hole formed through the mass and a damping member fitted loosely in the through-hole, the damping member being supported by the cover.

28. An acceleration-actuated switch as recited in claim 27, wherein the damping member is composed of silicon gel.

29. An acceleration-actuated switch as recited in claim 19, further comprising a thin film resistor formed on the cover and connected in parallel to the fixed contact.

* * * * *

UNITED STATES PATENT AND TRADEMARK OFFICE

CERTIFICATE OF CORRECTION

PATENT NO. : 6,080,944

DATED : June 27, 2000

INVENTOR(S) : Itoigawa et al.

It is certified that error appears in the above-identified patent and that said Letters Patent are hereby corrected as shown below:

On the first page, in the list of Inventors, after "Yoshida," insert Makoto Murate .
On the first page, in the Assignee, before "Japan" insert Aichi, .

Signed and Sealed this

Twenty-second Day of May, 2001

*Attest:*

Nicholas P. Godici

NICHOLAS P. GODICI

*Attesting Officer*

*Acting Director of the United States Patent and Trademark Office*